US005595057A

United States Patent [19]

Kuriya

[11] Patent Number: 5,595,057

[45] Date of Patent: Jan. 21, 1997

[54] STEEL CORDS FOR THE REINFORCEMENT OF RUBBER ARTICLES

[75] Inventor: Yoshinori Kuriya, Kodaira, Japan

[73] Assignee: Bridgestone Corporation, Tokyo, Japan

[21] Appl. No.: 393,893

[22] Filed: Feb. 24, 1995

[30] Foreign Application Priority Data

Feb. 24, 1994 [JP] Japan ..... 6-026446

[51] Int. Cl.[6] ..... D02G 3/07; D02G 3/06

[52] U.S. Cl. ..... 57/213; 57/214; 57/218; 57/230; 57/902

[58] Field of Search ..... 57/212–213, 214, 57/218, 230, 311, 902

[56] References Cited

U.S. PATENT DOCUMENTS

| | | | |
|---|---|---|---|
| 4,158,946 | 6/1979 | Bourgois | 57/902 |
| 4,628,683 | 12/1986 | Bourgois et al. | 57/230 |
| 4,763,466 | 8/1988 | Abe et al. | 57/213 |
| 5,351,470 | 10/1994 | Shimura | 57/902 |

FOREIGN PATENT DOCUMENTS

| | | | |
|---|---|---|---|
| 3279433 | 12/1991 | Japan | 57/902 |
| 3279432 | 12/1991 | Japan | 57/902 |
| 5-44183 | 2/1993 | Japan | 57/902 |
| 5-59677 | 3/1993 | Japan | 57/213 |
| 5179584 | 7/1993 | Japan . | |

OTHER PUBLICATIONS

Translation of Abstract of JPA–5–179584.

*Primary Examiner*—William Stryjewski

*Attorney, Agent, or Firm*—Sughrue, Mion, Zinn, Macpeak & Seas

[57] ABSTRACT

A steel cord for the reinforcement of rubber articles comprises a core comprised of three steel filaments, a first sheath formed by twisting nine wave-formed steel filaments around the core, and a second sheath formed by twisting fifteen wave-formed steel filaments around the first sheath in a direction opposite to the twisting direction of the first sheath, in which a forming ratio $F_1$ of each filament in the first sheath and a forming ratio $F_2$ of each filament in the second sheath are within a range of 0.75–0.95, respectively, and satisfy $Fi_1<F_2$.

3 Claims, 2 Drawing Sheets

STEEL CORDS FOR THE REINFORCEMENT OF RUBBER ARTICLES

BACKGROUND OF THE INVENTION

1. Field of the Invention

This invention relates to steel cords for the reinforcement of rubber articles such as pneumatic tires, industrial belts and the like and pneumatic radial tires using the same as a carcass ply for the improvement of tire durability.

2. Description of the Related Art

A typical example of rubber articles reinforced with steel cords, are known pneumatic tires. Among these tires, the tires for truck, bus and light truck use are common and have a carcass ply comprised of steel cords having a two or three layer twisting structure or so-called multilayer twisting structure.

In general, bending deformation is caused in the steel cord as a reinforcing material during the running of the tire, and hence fretting wear is created in each filament constituting the steel cord to inevitably decrease the sectional area of the filament and lower the tenacity of the steel cord.

If the decrease of sectional area in a portion of the filaments constituting the steel cord is violent, such a filament is apt to cause breakage to shock in tension or repetitive bending. Once the filament is broken, tensile stress increases in the remaining filaments to promote fatigue breakage of the steel cord. Therefore, in order to improve the durability of the steel cord, it is effective to avoid the premature breakage in a portion of the filaments and also it is desirable that the lowering of tenacity in all filaments constituting the steel cord is same.

SUMMARY OF THE INVENTION

It is, therefore, an object of the invention to improve the durability of the steel cord for the reinforcement of rubber articles by uniformly and gently proceeding the decrease of sectional area in the filaments constituting the cord based on fretting wear to equalize the decrease of tenacity in each of these filaments.

The inventors have made various studies with respect to the steel cords of multilayer twisting structure used in a heavy duty pneumatic tire, particularly steel cord of 3+9+15+1 structure causing the decrease of tenacity during the running of the tire when such steel cords are used in the carcass ply of the tire. As a result, it has been found that the decrease of tenacity in the filament constituting the outermost layer of the cord is very large and the main cause of decreasing the tenacity is fretting wear between the filament in the outer most layer and a wrap filament required for ensuring restraint of the filaments in this type of the cord and spirally wound around the outer periphery of the cord.

Now, the inventors have made further studies with respect to the steel cords removing the wrap filament for avoiding fretting wear and found that fretting wear through the wrap filament is naturally eliminated and the decrease of tenacity of the filament in the outermost layer can be suppressed. However the restraint of the filaments in the cord is lowered due to the absence of the wrap filament and these filaments are scattered when the cord is extremely bent. Hence, a phenomenon of breaking a part of the filaments due to abnormal input is caused to largely lower the service life of the cord as compared with the cord having a wrap filament. In order to prevent the lowering of the service life in the cord having no wrap filament due to the extreme bending input, therefore, it is required to ensure the restraint of the filaments constituting the cord.

If the restraint through the wrap filament is omitted, warp or torsion is caused in a layer used in, for example, a carcass ply of a tire, which considerably obstructs the assembling operability of a green tire. That is, the layers formed by coating a plurality of steel cords arranged in parallel to each other with rubber is cut into a given length and joined to each other for the formation of the carcass ply or belt layer. However, when using the steel cord having no restraint through the wrap filament, there is caused a phenomenon that the end portion of the layer after cutting is warped upward or downward or only the corner of the cut end portion is warped to form torsion. As a result, the transportation of the layer is obstructed due to the presence of warp or torsion, or it is impossible to join the layers to each other, so that the assembling accuracy of the green tire lowers and the operability thereof lowers. Even in the cord having no wrap filament, it is required to restrain the filaments constituting the cord.

That is, the invention has been accomplished based on the above knowledge.

According to the invention, there is the provision of a steel cord for the reinforcement of rubber articles comprising: a core comprised of three steel filaments, a first sheath formed by twisting nine wave-formed steel filaments around the core, and a second sheath formed by twisting fifteen wave-formed steel filaments around the first sheath in a direction opposite to the twisting direction of the first sheath, in which a forming ratio $F_1$ of each filament in the first sheath defined by a ratio of amplitude $H_1$ of wave formed in the filament to ideal diameter $D_1$ of the first sheath and a forming ratio $F_2$ of each filament in the second sheath defined by a ratio of amplitude $H_2$ of wave formed in the filament to ideal diameter $D_2$ of the second sheath are within a range of 0.75–0.95, respectively, and satisfy $F_1<F_2$.

In the steel cord of the above structure, each filament constituting the cord has naturally a certain twisting angle, so that a sectional shape of the cord in a direction perpendicular to the longitudinal direction of the cord is ellipsoidal near to circle. When such a shape is considered as a circle, the ideal diameter of each sheath is calculated according to the following equations:

$$D_1=(2\sqrt{3}/3+1)xr_c+2xr_1$$

$$D_2=(2\sqrt{3}/3+1)xr_c+2xr_1+2xr_2$$

where $r_c$: diameter of filament in core (mm)

$r_1$: diameter of filament in first sheath (mm)

$r_2$: diameter of filament in second sheath (mm).

Furthermore, the invention provides a pneumatic radial tire comprising a carcass of at least one carcass ply toroidally extending between a pair of bead portions, in which the carcass ply contains the above defined steel cords.

BRIEF DESCRIPTION OF THE DRAWINGS

The invention will be described with reference to the accompanying drawings, wherein.

DESCRIPTION OF THE PREFERRED EMBODIMENTS

Figure 1:
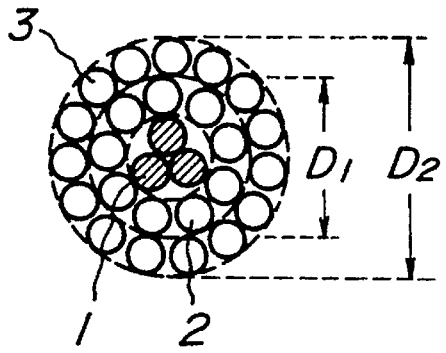
FIG. 1 is a diagrammatically sectional view of a steel cord having a 3+9+15 layer twisting structure according to the invention.

In FIG. 1 is sectionally shown a steel cord for the reinforcement of rubber articles according to the invention. Three steel filaments shown by oblique lines in FIG. 1 with core 1 as a central base structure of the cord, and a first sheath 2 formed by coaxially twisting nine steel filaments around the core 1 so as to arrange these filaments adjacent to each other, and a second sheath 3 formed by twisting fifteen steel filaments around the first sheath in a direction opposite to the twisting direction of the first sheath 2.

Figure 2:
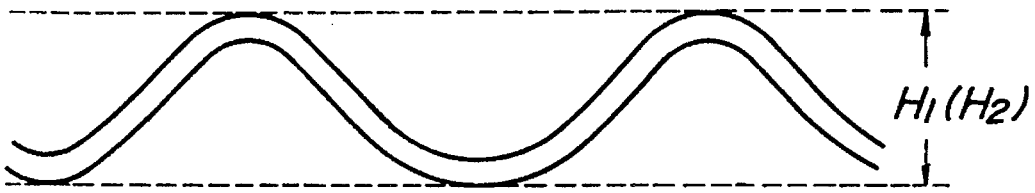
FIG. 2 is a schematic view illustrating an amplitude of a wave-formed steel filament.

Each of the filaments constituting the first sheath and second sheath is subjected to wave forming as shown in FIG. 2, whereby the operability in the formation of the second sheath 3 around the first sheath 2 is improved and also the restraint of the filaments in the cord after the twisting is ensured.

In forming the filaments for the first and second sheaths 2, 3, it is necessary that a forming ratio $F_1$ of each filament in the first sheath defined by a ratio of amplitude $H_1$ of wave formed in the filament to ideal diameter $D_1$ of the first sheath and a forming ratio $F_2$ of each filament in the second sheath defined by a ratio of amplitude $H_2$ of wave formed in the filament to ideal diameter $D_2$ of the second sheath are within a range of 0.75–0.95, respectively, and satisfy $F_1<F_2$.

Figure 3:
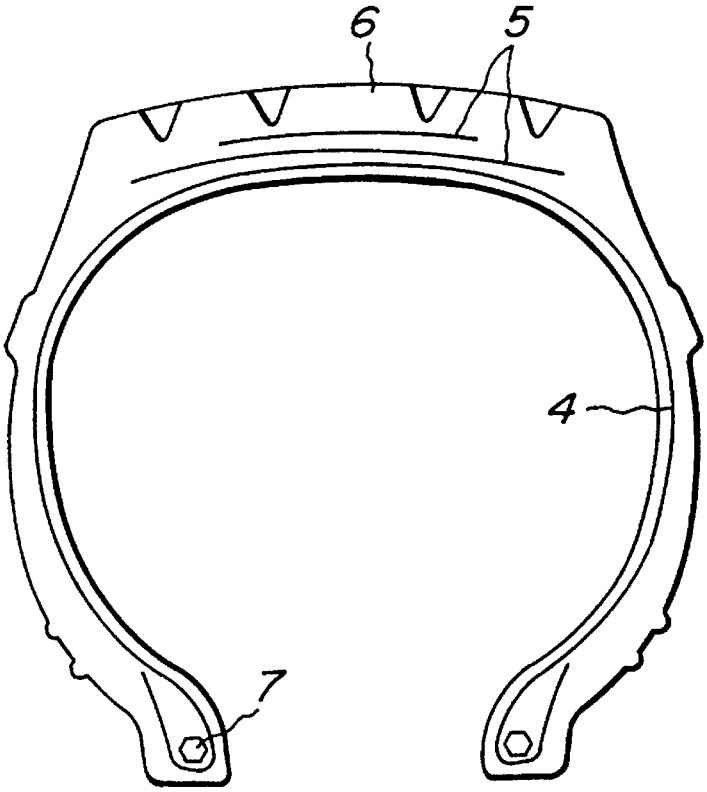
FIG. 3 is a section view of an embodiment of the pneumatic radial tire according to the invention.

Furthermore, the steel cords according to the invention are applicable to a carcass 4 in a pneumatic radial tire as shown, for example, in FIG. 3. In FIG. 3, numeral 5 designates belt layers covering a crown portion of the carcass 4, numeral 6 a tread portion superimposed about the belt layers 5, and numeral 7 a bead core.

As previously mentioned, the lowering of filament tenacity in the steel cord of the layer twisting structure, particularly the lowering of filament tenacity in the outermost layer is due to fretting wear created between the wrap filament and the filament in the outermost layer, for example, during the running of the tire. Because, the contact area between the wrap filament and the filament in the outermost layer is small, the contact pressure per unit area becomes large to create the fretting wear.

In case of turning the tire, torsion is caused in the cords of the carcass ply at the ground contact region of the tire. When such torsion is caused in a direction opposite to the twisting direction of the outermost layer, if the wrap filament is wound in a direction opposite to the twisting direction of the filaments constituting the outermost layer, torsion is caused in the wrap filament toward the same direction as the twisting direction of the filaments in the outermost layer. Hence, the wrap filament and the filaments of the outermost layer move in opposite directions to each other. Since the contact pressure per unit area is large, the decrease of sectional area in the filament in the outermost layer due to the fretting with the wrap filament is promoted by such an opposite movement to inevitably cause the lowering of filament tenacity.

For this end, when the wrap filament is removed from the cord of the layer twisting structure, the lowering of the filament tenacity in the outermost layer is avoided. However, when the twisting direction of each sheath in the cord is same, if the large bending input is applied as previously mentioned, the filaments of these sheaths are scattered and consequently a portions of these filaments is broken due to the abnormal input and finally the service life of the cord can not be improved.

On the contrary, when the steel cord having a 3+9+15 layer twisting structure is formed by removing the wrap filament, if the twisting direction of the first sheath is opposite to the twisting direction of the second sheath, the filaments of the second sheath restrain the filaments of the first sheath and develop the same restraining effect as in the wrap filament. Furthermore, the number of the filaments is large and the twisting pitch is long in the filaments of the second sheath bearing the restraint as compared with the wrap filament bearing the restraint. Thus, the contact pressure between the filaments of the second sheath becomes low and the lowering of filament tenacity due to the fretting wear becomes negligible.

Further, when the direction of torsion applied to the filaments of the second sheath is the same as in the twisting direction of these filaments, there is not naturally caused problem. On the other hand, when the torsion is applied in a direction opposite to the twisting direction of the second sheath, torsion is caused in the first sheath in a direction opposite to the twisting direction of the second sheath to control the movement of disentangling the first sheath, which acts to restrain the second sheath. As a result, the first sheath and the second sheath exert a restraining force upon each other to maintain the restraint between the filaments in each sheath of the cord.

According to the invention, when the forming ratio $F_1$ of each filament in the first sheath and the forming ratio $F_2$ of each filament in the second sheath are within a range of 0.75–0.95, preferably 0.85–0.95, respectively, and satisfy $F_1<F_2$, the restraint between the filaments in the cord becomes more sure and rigid and hence the stability to torsion of the cord itself or the resistance to torsion or disentanglement is improved.

Additionally, the restraint in the cord is rationalized, so that it is effective to improve the operability in factory manufacturing. Because, when the restraint in the cord is not adequate as mentioned above, the cord is apt to cause torsion and hence warp or torsion is created in the layer formed by coating the cords with rubber to bring about the increase of fraction defective and the lowering of productivity.

Incidentally, the cords of so-called rubber penetration structure in which rubber is penetrated into gap between filaments in outermost sheath layer as proposed in JP-A-5-179584 or the like tend to prolong the service life of the cord in the large bending input because the restraint through rubber is applied to the outermost sheath layer. However, the range of causing fretting wear is increased owing to the presence of the gaps between the filaments in the sheath for the formation of rubber penetration structure as compared with the cord of compactly twisted structure, which is unfavorable from a viewpoint of cord durability and tends to lower the resistance to corrosion fatigue.

Moreover, the mutual tightening effect by differing the twisting directions of the second sheath and the first sheath may be observed even in the two-layer twisted cord. In the latter case, the difference in the number of filaments between the core and the sheath is large, so that the force of controlling the disentangling of the sheath is small and the effect is less.

In order to prevent breakage of the filament in the cord, it is preferable to reduce the surface strain. In general, the surface strain of the filament $\epsilon$ is approximated by $\epsilon=D/2R$ (wherein D is a filament diameter, and R is a radius of curvature in the bending of the cord). Therefore, in order to reduce the surface strain $\epsilon$ under a certain bending input R, it is favorable to make the filament diameter D as fine as possible.

That is, in order to prevent the breakage of the filament against the extreme bending input applied to the carcass ply of the heavy duty pneumatic radial tire, in the cord exhibiting the effect according to the invention, it is favorable that the filament diameter is less than 0.220 mm. On the other hand, the lower limit of filament diameter is favorable to be 0.150 mm in view of the productivity and production cost. Further-more, in order to make the filament diameter as finer as possible and ensure the required cord tenacity, it is preferable to use a so-called high-strength steel material in which the tensile strength of the filament per unit sectional area is not less than 330 kgf/mm$^2$.

The following examples are given in illustration of the invention and are not intended as limitations thereof.

A pneumatic radial tire for truck and bus having a tire size of 1000R20 16PR and a tire structure as shown in FIG. 3 is manufactured by applying each of steel cords as shown in Tables 1 and 2 to a carcass ply of the tire at an end count of 22.0 cords/5 cm.

The retention of cord tenacity, percentage of filament breakage, fretting depth and operability in factory are measured with respect to the resulting tire to obtain results as shown in Tables 1 and 2.

The retention of cord tenacity is evaluated as follows: that is, the test tire inflated under an internal pressure of 8 kgf/cm$^2$ is run at a speed of 60 km/h under JIS 100% load over a distance of 300,000 km by conducting retreading every a running distance of 100,000 km and thereafter the sample of the rubberized steel cord is taken out from the carcass ply of the test tire after the running and placed on an Instron tensile testing machine to measure the tensile strength of the sample. The retention of cord tenacity (%) is calculated by a ratio of the measured value to a value of tensile strength of the cord before assembling into the tire. The calculated value is represented by an index on the basis that the result of Comparative Example 1 is 100. The larger the index value, the better the retention of cord tenacity.

The percentage of filament breakage is represented by a percentage of the number of broken filaments in 10 cords taken out from the carcass ply after the test tire is run on a drum under an internal pressure of 1 kgf/cm$^2$ over a distance of 10,000 km to the total number of filaments in 10 cords. The smaller the numerical value, the better the resistance to filament breakage. Particularly, a percentage of filament breakage of not more than 10% is preferable.

Figure 4:
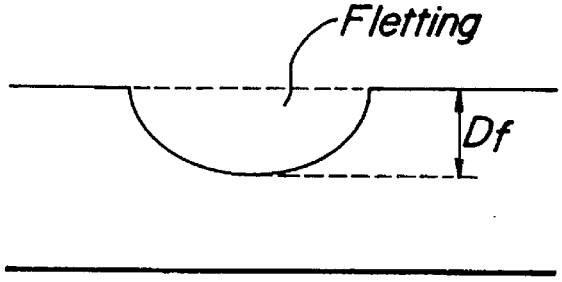
FIG. 4 is a schematic view illustrating a fretting depth of the steel filament.

The fretting depth is measured as follows. After the test tire is run on the drum over a distance of 100,000 km under the same conditions as in the retention of cord tenacity, two steel filaments in each of the first and second sheaths are taken out from the steel cord in the carcass ply of the tire and a quantity of filament diameter $D_f$ reduced due to fretting wear as shown in FIG. 4 is measured every filament within a region of 13 cm±2 cm from the widthwise center of the tread. A maximum value among the measured values is evaluated as the fretting depth. The smaller the numerical value, the better the resistance to fretting wear. The fretting depth is desirable to be not more than 20 μm.

In the operability in factory manufacture, the fraction defective and productivity of the layer containing steel cords at each production step of from twisting step to the tire build-up step are evaluated by three stages, in which symbol ○ is no problem, symbol Δ a partly problem (e.g. it is required to remove the catching of the transporting layer) and symbol X a great problem (e.g. the operation is delayed due to the catching of the layer in a tire building machine or the poor joint between the layers lowers the assembling accuracy of the green tire).

TABLE 1

| | Comparative Example 1 | Comparative Example 2 | Comparative Example 3 | Comparative Example 4 | Comparative Example 5 | Comparative Example 6 |
|---|---|---|---|---|---|---|
| Twisting structure | 3 + 9 + 1 | 3 + 9 | 3 + 9 | 3 + 9 + 15 + 1 | 3 + 9 + 15 | 3 + 9 + 13 |
| Filament diameter | 0.22 | 0.22 | 0.22 | 0.17 | 0.17 | 0.17 |
| Twisting direction | S/S/Z | S/S | S/Z | S/S/Z/S | S/S/S | S/S/Z |
| Twisting pitch (mm) | 6/12/3.5 | 6/12 | 6/12 | 5/10/15/3.5 | 5/10/15 | 5/10/15 |
| $F_1$ | 0.95 | 0.94 | 0.95 | 0.82 | 0.85 | 0.86 |
| $F_2$ | 0.94 | 0.94 | 0.95 | 0.63 | 0.91 | 0.88 |
| Retention of cord tenacity | 91 | 98 | 93 | 87 | 97 | 92 |
| Percentage of filament breakage (%) | 43 | 100 | 78 | 14 | 17 | 4 |
| Fretting depth (max value: μm) | 37 | 7 | 19 | 34 | 11 | 28 |
| Operability in factory | ○ | x | Δ | ○ | x | ○ |

TABLE 2

| | Comparative Example 7 | Comparative Example 8 | Acceptable Example 1 | Acceptable Example 2 | Acceptable Example 3 | Acceptable Example 4 |
|---|---|---|---|---|---|---|
| Twisting structure | 3 + 9 + 15 | 3 + 9 + 15 | 3 + 9 + 15 | 3 + 9 + 15 | 3 + 9 + 15 | 3 + 9 + 15 |
| Filament diameter | 0.17 | 0.17 | 0.17 | 0.17 | 0.155 | 0.155 |
| Twisting direction | S/S/Z | S/S/Z | S/S/Z | S/S/Z | S/S/Z | S/S/Z |
| Twisting pitch (mm) | 5/10/15 | 5/10/15 | 5/10/15 | 5/10/15 | 5/10/15 | 5/10/15 |
| $F_1$ | 0.85 | 0.70 | 0.87 | 0.76 | 0.79 | 0.93 |
| $F_2$ | 0.60 | 1.00 | 0.88 | 0.94 | 0.91 | 0.95 |
| Retention of cord tenacity | 94 | 93 | 95 | 94 | 95 | 96 |
| Percentage of filament breakage (%) | 6 | 8 | 5 | 6 | 4 | 4 |
| Fretting depth (max valuc: μm) | 17 | 21 | 16 | 17 | 15 | 14 |
| Operability in factory | Δ | Δ | ○ | ○ | ○ | ○ |

As seen from Tables 1 and 2, Comparative Examples 1, 4 and 6 are good in the operability in factory manufacture owing to the restraint through the wrap filament, but are large in the fretting depth. In Comparative Examples 2 and 5, the fretting depth is small, but the operability in factory is poor. In Comparative Example 3, the effect is less though the twisting directions of the core and the sheath are opposite. In Comparative Examples 7 and 8, the forming ratio of the filament in the sheath is outside the range defined in the invention, so that the operability in factory is poor.

As mentioned above, in the steel cord according to the invention, the fretting wear between the filament in the outermost sheath layer and the wrap filament is eliminated and the tenacity of the filament in the cord is proceeded uniformly and gently to improve the service life of the cord. As a result, the durability of the rubber article reinforced with such steel cords. e.g. the durability of the pneumatic tire can be improved.

What is claimed is:

1. A steel cord for the reinforcement of rubber articles comprising: a core comprised of three steel filaments, a first sheath formed by twisting nine wave-formed steel filaments around the core, and a second sheath formed by twisting fifteen wave-formed steel filaments around the first sheath in a twisting direction opposite to the twisting direction of the first sheath, wherein a forming ratio $F_1$ of each filament in the first sheath is defined by a ratio of amplitude $H_1$ of a wave formed in the filament to a first diameter $D_1$ of the first sheath, and a forming ratio $F_2$ of each filament in the second sheath is defined by a ratio of amplitude $H_2$ of wave formed in the filament to a second diameter $D_2$ of the second sheath such that $F_1$ and $F_2$ are within a range of 0.75–0.95, respectively, and satisfy $F_1<F_2$.

2. The steel cord according to claim 1, wherein the forming ratio $F_1$ of each filament in the first sheath and the forming ratio $F_2$ of each filament in the second sheath are within a range of 0.85–0.95, respectively.

3. The steel cord according to claim 1, wherein each of the steel filaments has a diameter of not less than 0.150 mm but less than 0.220 mm and a tensile strength of not less than 330 kgf/mm$^2$.

* * * * *